US009963901B2

(12) United States Patent
Kanzaki

(10) Patent No.: US 9,963,901 B2
(45) Date of Patent: May 8, 2018

(54) SEISMIC ISOLATOR

(71) Applicant: Takahiro Kanzaki, Tokyo (JP)

(72) Inventor: Takahiro Kanzaki, Tokyo (JP)

( * ) Notice: Subject to any disclaimer, the term of this patent is extended or adjusted under 35 U.S.C. 154(b) by 0 days. days.

(21) Appl. No.: 14/909,682

(22) PCT Filed: Feb. 5, 2015

(86) PCT No.: PCT/JP2015/053886

§ 371 (c)(1),
(2) Date: Feb. 2, 2016

(87) PCT Pub. No.: WO2015/119303

PCT Pub. Date: Aug. 13, 2015

(65) Prior Publication Data

US 2016/0340924 A1 Nov. 24, 2016

(30) Foreign Application Priority Data

Feb. 10, 2014 (JP) ..... 2014-001024

(51) Int. Cl.
*E04H 9/02* (2006.01)
*E04B 1/36* (2006.01)
*E04B 1/98* (2006.01)

(52) U.S. Cl.
CPC ..... *E04H 9/023* (2013.01); *E04B 1/36* (2013.01); *E04B 1/98* (2013.01)

(58) Field of Classification Search
CPC ..... E04H 9/023; E04H 9/022; E04H 9/021; E04H 9/027; E04H 9/028; E04H 9/06; E04H 9/029; E04B 1/98; E04B 1/36
(Continued)

(56) References Cited

U.S. PATENT DOCUMENTS 99,973 A * 2/1870 Touaillon ..... E04H 9/023 52/167.5
951,028 A * 3/1910 Schar ..... E04H 9/023 52/167.5

(Continued)

FOREIGN PATENT DOCUMENTS

CA 2157942 A1 * 3/1997 ..... E04H 9/021
DE 10353907 A1 * 6/2005 ..... E04H 9/023

(Continued)

OTHER PUBLICATIONS

International Search Report for International Application No. PCT/JP2015/053886, dated Apr. 21, 2015, Japan Patent Office, Tokyo, JP.

*Primary Examiner* — Babajide A Demuren
(74) *Attorney, Agent, or Firm* — Stephen J. Weyer; Stites & Harbison PLLC

(57) ABSTRACT

A seismic isolator is provided in a building and maintains the horizontalness of the building. The isolator includes a foundation base plate in contact with the ground surface, and a foundation top plate on which a building is mounted, the foundation base plate and the foundation top plate being in intimate contact with each other leaving no space and being individually directly formed with a curved surface symmetrically facing each other; and a spherical body positioned at the center of the curved surfaces, when the foundation base plate moves as a result of horizontal vibrations caused by an earthquake, the spherical body rotates and rolls along the curved surfaces to raise the foundation top plate; thereby the vibrations are hindered from being transmitted to the foundation top plate to perform seismic-isolation action on the building; and after the earthquake subsides, the spherical body returns to the center of the curved surfaces.

1 Claim, 2 Drawing Sheets

(58) Field of Classification Search
USPC ..... 52/167.5, 167.6
See application file for complete search history.

(56) References Cited

U.S. PATENT DOCUMENTS

| | | | | | |
|---|---|---|---|---|---|
| 1,761,659 | A * | 6/1930 | Cummings | E04H 9/023 | 52/167.5 |
| 2,014,643 | A * | 9/1935 | Bakker | E04H 9/023 | 384/49 |
| 2,359,036 | A * | 9/1944 | Harper | B60G 99/002 | 105/187 |
| 4,517,778 | A * | 5/1985 | Nicolai | E04H 9/023 | 384/49 |
| 4,881,350 | A * | 11/1989 | Wu | E04H 9/023 | 248/580 |
| 5,071,261 | A * | 12/1991 | Stuve | E04H 9/023 | 14/73.5 |
| 5,081,806 | A * | 1/1992 | Pommelet | E04H 9/023 | 52/167.5 |
| 5,599,106 | A * | 2/1997 | Kemeny | E04H 9/023 | 384/36 |
| 5,689,919 | A * | 11/1997 | Yano | E04H 9/023 | 248/550 |
| 6,321,492 | B1 * | 11/2001 | Robinson | E02D 27/34 | 52/167.1 |
| 6,505,806 | B1 * | 1/2003 | Glaesener | F16F 7/00 | 248/638 |
| 6,688,051 | B2 * | 2/2004 | Tsai | E01D 19/04 | 248/636 |
| 6,725,612 | B2 * | 4/2004 | Kim | E04H 9/023 | 52/167.1 |
| 6,971,795 | B2 * | 12/2005 | Lee | E04H 9/023 | 14/73.5 |
| 2006/0048462 | A1 * | 3/2006 | Huang | E04H 9/023 | 52/167.5 |
| 2007/0220815 | A1 * | 9/2007 | Kemeny | E04H 9/02 | 52/167.3 |
| 2012/0124920 | A1 * | 5/2012 | Alsaif | E04H 9/023 | 52/167.5 |
| 2012/0222369 | A1 * | 9/2012 | Kemeny | E04H 9/023 | 52/167.5 |

FOREIGN PATENT DOCUMENTS

| | | | | |
|---|---|---|---|---|
| DE | 102005022734 | A1 * | 11/2006 | E04H 9/023 |
| DE | 102014004059 | A1 * | 9/2015 | E04H 9/023 |
| JP | 3-62247 | | 6/1991 | |
| JP | 2001-90091 | | 4/2001 | |
| JP | 2005-538314 | | 12/2005 | |
| WO | WO 0142593 | A3 * | 1/2002 | E01D 19/043 |
| WO | WO-2004/007871 | | 1/2004 | |

* cited by examiner

SEISMIC ISOLATOR

TECHNICAL FIELD

The present invention relates to a seismic isolator for a building at the time of an earthquake.

BACKGROUND ART

Seismic isolators are known which are provided in a building and hinder vibrations from being transmitted to the side of the building when an earthquake occurs. Among the seismic isolators, for example, as described below, Patent Document 1 shows "an air-bag seismic isolator" which allows a control means, such as a sensor detecting vibrations, to inflate an air bag thereof. Patent Document 2 shows "an air-pressure seismic-isolation positional-shift restorer" which inflates an air sack after an earthquake subsides and thereby restores an upper foundation and a lower foundation from a positional shift thereof. However, the air bag or air sack employed therein operates with the air stored in an air tank, and hence, once the air bag or sack operates by sensing a seismic motion, then it needs refilling with air, thereby taking time. This means that when a great earthquake occurs, the air bag or sack may be unusable against aftershocks following the earthquake. Patent Document 3 shows "a magnetic-levitation seismic isolator" which obtains a seismic-isolation effect by utilizing the repulsion of the magnetic forces of magnets provided in upper and lower foundations. When an earthquake occurs, the seismic isolator senses vibrations caused thereby, and then, leads an electric current to flow between the electromagnets. In addition, among seismic-isolation mechanisms employed for seismic isolators, there are a rolling seismic-isolation bearing, a laminated-rubber bearing, a sliding seismic-isolation bearing and the like. The rolling seismic-isolation bearing is provided with a ball, a roller or the like, and the ball, the roller or the like is borne by a flat or concave plate and rolls thereon. Consequently, the rolling seismic-isolation bearing requires a plate-like bearer. Furthermore, measures to prevent winds from vibrating a seismic isolator need to be regularly taken.

PRIOR ART DOCUMENTS

Patent Document 1: Japanese Patent Laid-Open Publication No. 2001-90091

Patent Document 2: Japanese Patent Laid-Open Publication No. 2008-208696

Patent Document 3: Utility Model Registration Publication No. 3121888

SUMMARY OF THE INVENTION

Problems to be Solved by the Invention

It is an object of the present invention to obtain a seismic isolator which is provided in a building and maintains the horizontalness of the building, characterized by including: a foundation base plate arranged in contact with the ground surface, and a foundation top plate on which a building is mounted, the foundation base plate and the foundation top plate being in intimate contact with each other and being individually directly formed with a curved surface symmetrically facing each other, for example, in the four corners of the building; and a spherical body positioned at the center of the curved surfaces, characterized in that: as a result of horizontal vibrations caused by an earthquake, the spherical body smoothly rotates and rolls along the curved surfaces; thereby the foundation top plate rises to perform seismic-isolation action on the building; and after the earthquake subsides, the spherical body returns to the center of the curved surfaces. The seismic isolator is continuously and consecutively usable at all times.

Means for Solving the Problems

A seismic isolator A is characterized by including: a foundation base plate 1 arranged in contact with the ground surface, and a foundation top plate 2 on which a building B is mounted, the foundation base plate 1 and the foundation top plate 2 being in intimate contact with each other and being individually directly formed with a curved surface 3, 3' symmetrically facing each other, for example, in the four corners of the building B; and a spherical body 7 positioned at the center of the curved surfaces 3 and 3' and is characterized in that: when the foundation base plate 1 moves as a result of horizontal vibrations caused by an earthquake, the spherical body 7 smoothly rotates and rolls along the curved surfaces 3 and 3' to raise the foundation top plate 2; thereby the vibrations are hindered from being transmitted to the foundation top plate 2 to perform seismic-isolation action on the building B; and after the earthquake subsides, the spherical body 7 returns to the center of the curved surfaces 3 and 3'.

Advantages of the Invention

The seismic isolator according to the present invention maintains the horizontalness of a building at the time of an earthquake or the like, characterized by including: a foundation base plate arranged in contact with the ground surface, and a foundation top plate on which a building is mounted, the foundation base plate and the foundation top plate being in intimate contact with each other and being individually directly formed with a curved surface symmetrically facing each other, for example, in the four corners of the building; and a spherical body positioned at the center of the curved surfaces and characterized in that: when an earthquake causes horizontal vibrations in any directions over an angle of 360°, the spherical body smoothly rotates and rolls along the curved surfaces to raise the foundation top plate; thereby the vibrations are hindered from being directly transmitted to the side of the foundation top plate to perform seismic-isolation action on the building; and after the earthquake subsides, the spherical body returns naturally to the center of the curved surfaces. The seismic isolator has an entirely mechanical and simple configuration and thereby is certainly usable continuously and consecutively.

Particularly, the seismic isolator dispenses with a sensing means for an earthquake, and hence, there is no need to provide an earthquake-sensing means indispensable for Patent Documents 1, 2 and 3 described in Prior Art Documents. Needless to say, it is unnecessary to separately provide a standby power source, an in-house power generator, a battery or the like in case of power failure. Accordingly, the seismic isolator according to the present invention is useful for countermeasures against not only an earthquake but also aftershocks following the earthquake. Further, the seismic isolator is also useful in coping with vibrations/shaking in windstorm and flood damage, and other disasters.

MODE FOR CARRYING OUT THE INVENTION

Figure 1:
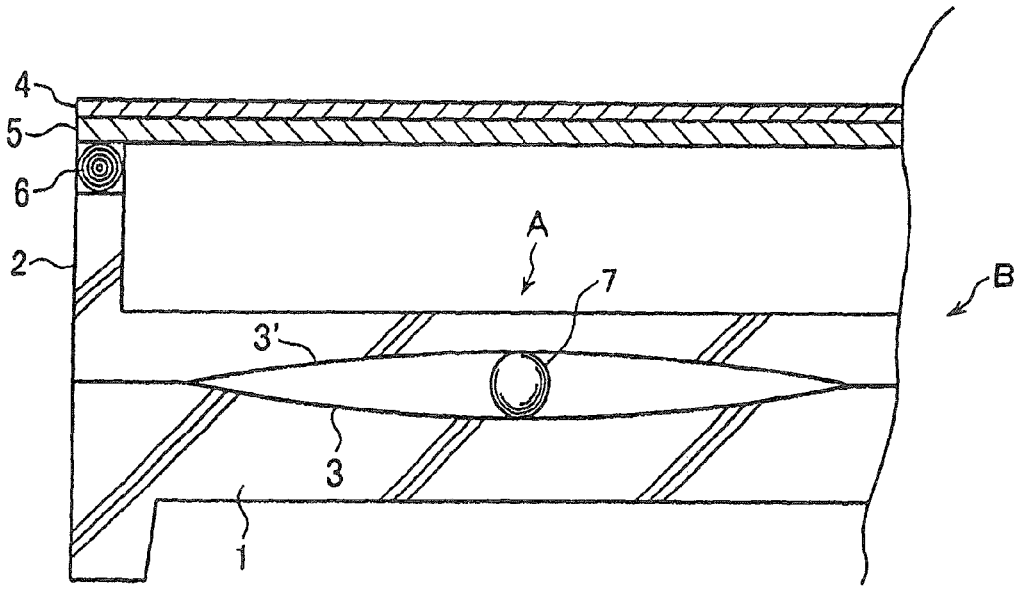
FIG. 1 is a partial sectional view showing a seismic isolator according to the present invention.

FIG. 1 is a partial sectional view (seen along the a-a' line of FIG. 2) showing a seismic isolator A according to an embodiment of the present invention. Reference character B denotes a building; reference numeral 1 denotes a foundation base plate (such as reinforced concrete); 2, a foundation top plate (such as reinforced concrete); 3, 3', a curved surface (which is directly formed in each of the foundation base plate 1 and the foundation top plate 2, or alternatively, which may be shaped out of an iron sheet, a rigid synthetic resin or the like and attached thereto); 4, a floor; 5, a subfloor; 6, a support timber; and 7, a spherical body (e.g., a steel ball). The single spherical body 7 is provided between the curved surfaces 3 and 3'.

Figure 2:
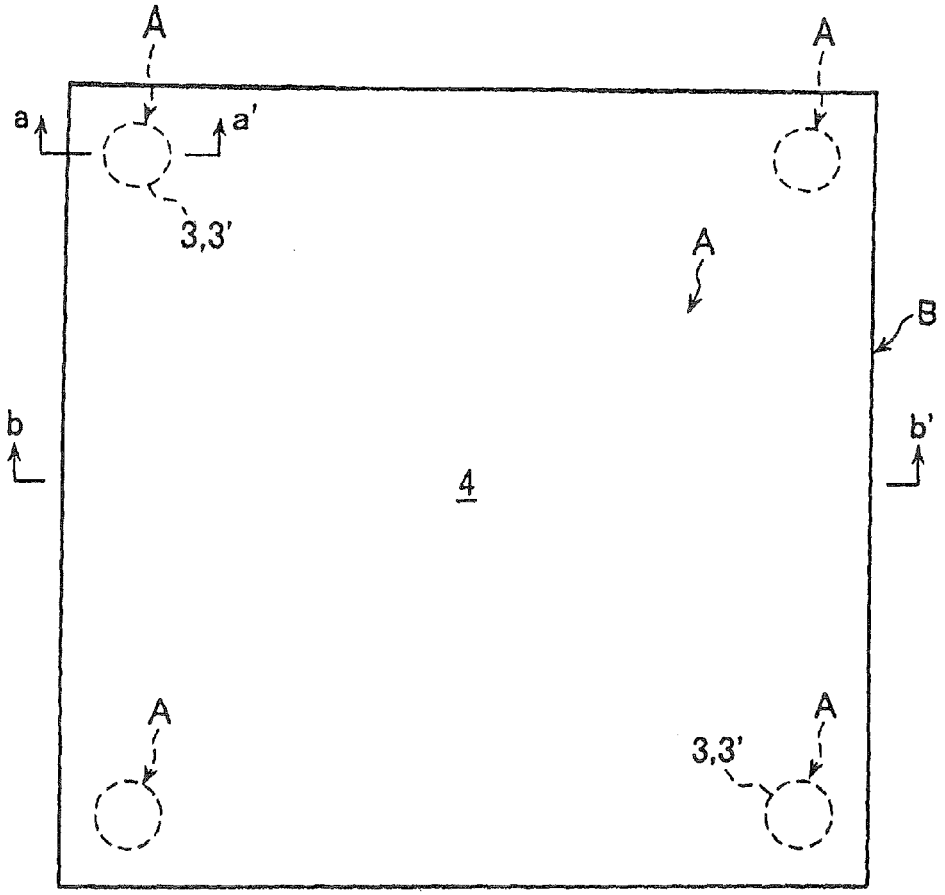
FIG. 2 is a plan view of a building provided with the seismic isolator according to the present invention.
Figure 3:
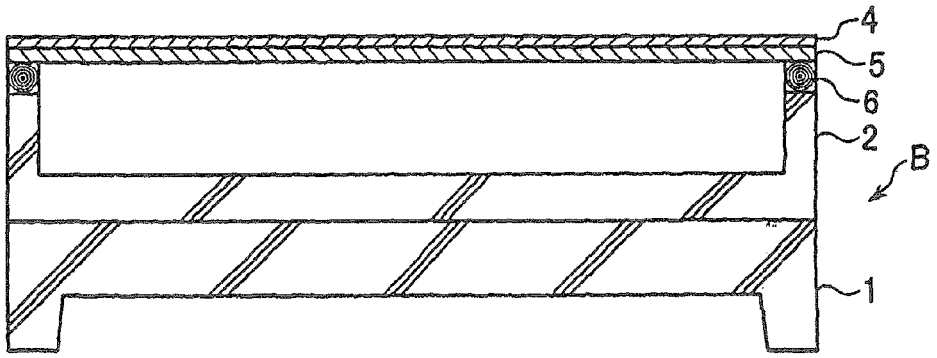
FIG. 3 is a sectional view seen along the b-b' line of FIG. 2.

As shown in the plan view of FIG. 2, the seismic isolator A according to the embodiment of the present invention is provided, in this example, in the four corners of the building B, and the four seismic isolators A maintain the horizontalness of the building B. Specifically, the seismic isolator A is configured, as shown in FIG. 1, such that the foundation base plate 1 arranged in contact with the ground surface and the foundation top plate 2 on which the building B is mounted are in intimate contact with each other and are individually directly formed with the curved surface 3, 3' symmetrically facing each other, and such that the single spherical body 7 is positioned at the center of the curved surface 3, 3'. According to the configuration, at an ordinary time, the foundation top plate 2 will not move by its own weight with respect to the foundation base plate 1. When an earthquake causes the ground to move up and down to trigger horizontal vibrations, if the foundation base plate 1 horizontally moves, then the spherical body 7 rotates and rolls along the curved surfaces 3 and 3' to raise the foundation top plate 2. This hinders the horizontal vibrations from being transmitted to the foundation top plate 2, that is to say, to the building B mounted thereon to perform seismic-isolation action on the building B. In other words, even if the horizontal vibrations are in any directions over an angle of 360°, the spherical body 7 smoothly rotates and rolls along the curved surfaces 3 and 3' to hinder the seismic motion from being directly transmitted to the side of the foundation top plate 2, thereby performing seismic-isolation action on the building B. After the seismic motion has subsided, the spherical body 7 will certainly return to the center of the curved surfaces 3 and 3'.

INDUSTRIAL APPLICABILITY

After a great earthquake has occurred, the earthquake will be frequently followed by aftershocks. On all such occasions, the seismic isolator according to the present invention is perfectly reliable because it operates absolutely certainly at all times. The seismic isolator has an entirely mechanical configuration, and thereby, it is certainly operable and is producible at a lower cost, in other words, economical. Further, the number of the seismic isolators according to the present invention is variable, and in accordance with the size of a building, may be increased or decreased so that the whole building can be kept horizontal.

Still further, the seismic isolators stay unmoved against vibrations caused by winds, thereby dispensing with measures to cope with the wind vibrations.

DESCRIPTION OF THE SYMBOLS

A: seismic isolator
B: building
1: foundation base plate
2: foundation top plate
3, 3': curved surface
4: floor
5: subfloor
6: support timber
7: spherical body

The invention claimed is:

1. A seismic isolator which is provided in a building and maintains the horizontalness of the building, said seismic isolator comprising:

a foundation base plate arranged in contact with the ground surface, and a foundation top plate on which a building is mounted, a whole continuous surface of the foundation base plate and a whole continuous bottom surface of the foundation top plate being in direct contact with each other leaving no space therebetween, at least one curved surface formed in a surface of the foundation base plate completely surrounded by the continuous surface of the foundation base plate symmetrically facing a curved surface in the bottom of the foundation top plate completely surrounded by the continuous bottom surface of the foundation top plate; and a spherical body positioned at the center of the curved surfaces, wherein, when the foundation base plate moves as a result of horizontal vibrations caused by an earthquake, the spherical body rotates and rolls along the curved surfaces to raise the foundation top plate; thereby the vibrations are hindered from being transmitted to the foundation top plate to perform seismic-isolation action on the building; and after the earthquake subsides, the spherical body returns to the center of the curved surfaces.

* * * * *